United States Patent [19]

Cox

[11] 4,014,161

[45] Mar. 29, 1977

[54] STOP-MOTION DEVICE FOR AUTOMATIC DOFFER APPARATUS

[75] Inventor: William L. Cox, Pickens, S.C.

[73] Assignee: Platt Saco Lowell Corporation, Greenville, S.C.

[22] Filed: May 26, 1976

[21] Appl. No.: 690,214

[52] U.S. Cl. ..... 57/52; 57/78

[51] Int. Cl.[2] ..... D01H 9/04; D01H 13/14

[58] Field of Search ..... 57/52–54, 57/34 R, 78, 79

[56] References Cited

UNITED STATES PATENTS

| | | | |
|---|---|---|---|
| 3,786,621 | 1/1974 | Pray et al. | 57/52 |
| 3,791,124 | 2/1974 | Kaufmann et al. | 57/52 |
| 3,793,818 | 2/1974 | Yamamoto | 57/52 |
| 3,823,538 | 7/1974 | Igel | 57/52 |
| 3,827,227 | 8/1974 | Pray et al. | 57/52 |
| 3,895,482 | 7/1975 | Schulz et al. | 57/52 |

*Primary Examiner*—John Petrakes
*Attorney, Agent, or Firm*—Joseph H. Heard

[57] ABSTRACT

The doffing apparatus services a textile machine having a row of bobbin-receiving spindles extending in its length direction, and includes an elongate bobbin grasper member which projects generally parallel to the row of spindles and is movable relative thereto between elevated and lowered positions for the purpose of transporting bobbins to and from the spindles. The stop motion device is actuable by impedence of the aforesaid movement of the bobbin-grasper member, as reflected by relative movement that then transpires between components which support such member.

11 Claims, 6 Drawing Figures

STOP-MOTION DEVICE FOR AUTOMATIC DOFFER APPARATUS

BACKGROUND OF THE INVENTION

This invention relates to an improved stop-motion device for an automatic doffing apparatus of the general type disclosed in U.S. Pat. Nos. 3,786,621, 3,827,227 and 3,823,538, among others. Such apparatus services a textile spinning frame or like machine having at least one row of bobbin-receiving spindles extending longitudinally thereof. The apparatus includes a bobbin grasper member and a reciprocatorily-movable draw bar member which extend generally parallel to the row of spindles along substantially its entire length. A plurality of articulated linkage mechanisms innerconnect the aforesaid members such that, upon reciprocatory movement of the draw bar member, the bobbin grasper member moves between elevated and lowered positions relative to the spindles for the purpose of transporting bobbins thereto and therefrom.

A particularly critical phase of the operation of a doffing apparatus of the above-described type is that during which the bobbin grasper member raises or "doffs" full bobbins (i.e., ones upon which desired quantities of yarn have been wound) from the spindles of the textile machine serviced by the apparatus, and then transports such full bobbins downwardly to a location adjacent the base of the machine. As the full bobbins are doffed from the spindles, the yarn innerconnections between such packages and the textile machine are supposed to be severed, ruptured or otherwise broken. When this occurs the full bobbins will depend in a uniformly proper and non-obstructive manner from the bobbin grasper member during the latter's downward movement from an elevated and to a lowered position. It sometimes happens, however, that the yarn innerconnection will not be broken between the textile machine and one of the many full bobbins simultaneously doffed from the spindles by the bobbin grasper member. Any full bobbin whose yarn innerconnection remains intact during the thereafter ensuing downward movement of the bobbin grasper member will not depend properly from such member, but rather may and likely will be so canted as to become wedged between the bobbin grasper member and the spindle rail or some other component of the textile machine, thus impeding or completely arresting further downward movement of at least one longitudinal expanse of the bobbin grasper member. Attempted continuation of the bobbin grasper member's downward movement in the face of a motion-impeding blockage of the aforesaid or similar type can cause severe structural damage to the bobbin grasper member and/or to other components of the doffing apparatus or the textile machine serviced by it.

It an effort to guard against such undesirable consequences, it has heretofore been proposed to so program the control circuitry of doffing apparatus of the described type as to require operator participation in that part of the apparatus' operating cycle involving the aforesaid "critical" movement of the bobbin grasper member. This approach necessitates the availability of a machine operator who is sufficiently diligent to carefully look for possible impediments to movement of the bobbin grasper member, and who is sufficiently dexterous to halt operation of the apparatus prior to its incurring structural damage in the event that a blockage or impediment is detected. Such approach is undesirable since it places excessive reliance upon the varying capabilities of different operators, and also since it detracts from the efficiency and otherwise fully automated operation of the doffing apparatus.

It has also heretofore been proposed to provide automatic stop-motion means in association with an automatic doffing apparatus for the purpose of detecting blockage of movement of the bobbin grasper member of such apparatus: see U.S. Pat. No. 3,895,482. In all of the various embodiments of the stop-motion means specifically shown and described in the aforesaid patent, the bobbin grasper member is specially constructed so as to provide separate switch contacts in association with each of the bobbin grasper elements spaced along the length of such member. In view of the fact that there would customarily be more than one hundred bobbin grasper elements spaced along the length of the bobbin grasper member, it will be appreciated that stop-motion means of the aforesaid construction significantly increases the cost of the doffing apparatus and requires, for its successful utilization, reliable operation over an extended period of time of myriad switch-contacts. The patent also suggests the possibility of providing only a single stop-motion detector in association with the bobbin grasper member or its driving mechanism in those cases when such member mounts only one or a small number of bobbin grasper elements. The provision of stop-motion means including only a single detector or switch element is also highly desirable from the viewpoint of both economy and reliability, when as in the present doffing apparatus the bobbin grasper member has a multiplicity of bobbin grasper elements spaced along its length. However, such a stop-motion means must at the same time possess sufficient sensitivity as to reliably and immediately detect a blockage of or impediment to movement of the grasper bar member at any point along its considerable length, prior to the effect of such blockage or impediment being transmitted throughout the length of and causing structural damage to such member and/or of other elongate structural components of the doffing apparatus.

OBJECTS OF THE INVENTION

With the foregoing in mind, the primary object of the present invention is the provision in association with an automatic doffing apparatus of the type described of an improved stop-motion device which is actuable by impedence of the movement between its elevated and lowered positions of the grasper bar member of the doffing apparatus and which, upon actuation, is effective to halt operation of the apparatus.

A related and more specific object is the provision of a stop-motion device, of the above described kind, which is exceedingly reliable in its operation and is rapidly actuated in response to the presence of an impediment to movement of the elongate bobbin-grasper member irrespective of the particular location along the length of the textile machine at which such impediment is present, but which may and preferably does include only a single switch element and which is of exceedingly durable and economical construction.

SUMMARY OF THE INVENTION

In accordance with the present invention, a lower end portion of each of the linkage mechanisms innerconnecting the bobbin grasper member and the draw bar member of the automatic doffing apparatus is so connected to the draw bar member that relative linear movement occurs between the draw bar member and the lower end portion of that linkage mechanism most closely adjacent a blockage or impediment encountered by the bobbin grasper member during movement thereof between elevated and lowered positions. Relative linear movement between the draw bar member and the lower end portion of any of the linkage mechanisms actuates a stop-motion switch connected to the draw bar member, and thus immediately halts operation of the doffing apparatus. The switch-actuating means includes a cable or similar elongate member which extends in adjacent relationship to the switch element and to the innerconnections between the draw bar member and the lower end portions of all of the linkage mechanisms.

DESCRIPTION OF THE DRAWINGS

Other details of the invention will be apparent from the following description of a preferred embodiment thereof, which should be read in conjunction with the accompanying drawings, in which.

DESCRIPTION OF THE ILLUSTRATIVE EMBODIMENT

Figure 1:
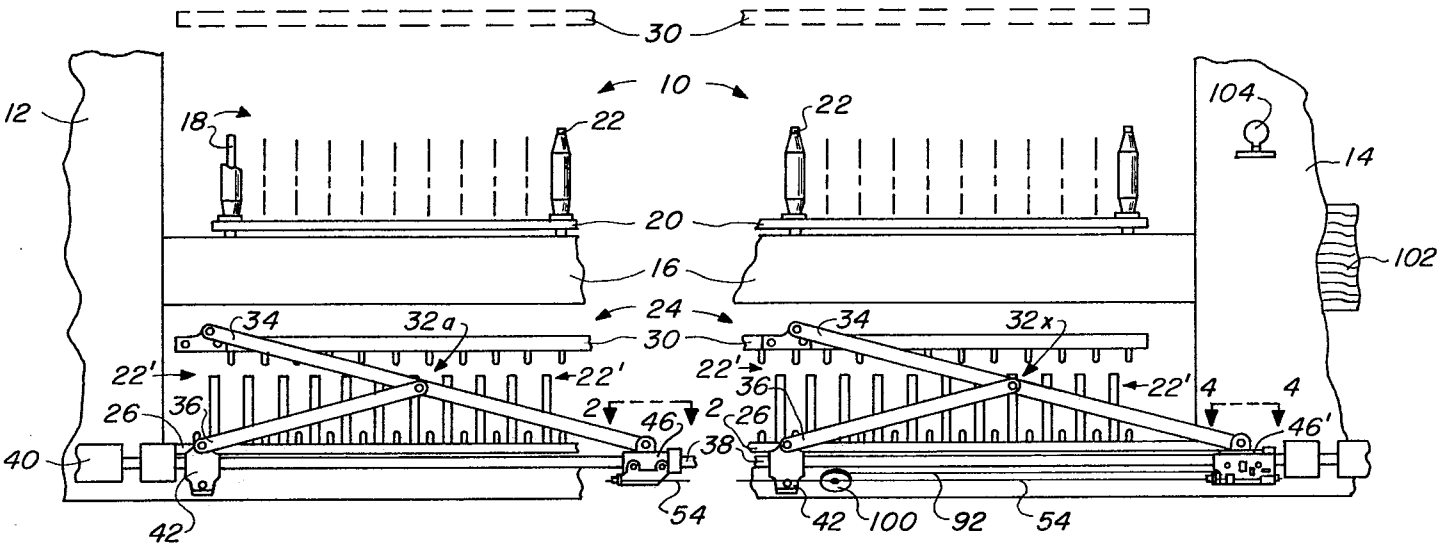
FIG. 1 is a fragmentary and partially schematic front elevational view of a textile spinning frame or similar machine serviced by an automatic doffing apparatus equipped with a stop-motion device in accordance with the invention.

In FIG. 1 the numeral 10 designates a spinning frame or similar textile machine, only portions of one side of which are shown, having opposite end cabinets 12, 14 between which there extends a spindle rail 16 mounting a row of upright bobbin-receiving spindles 18 which during operation of machine 10 are rotated about their axes and traversed by a vertically movable ring rail 20 as yarn is directed thereto from the machine's creel and drafting element components (not shown) disposed thereabove. The total number of spindles 18 mounted upon rail 16 will vary in accordance with the total length of machine 10, only a fragmentary portion of which is shown, but may exceed two hundred. The yarn passing during operation of machine 10 to spindles 18 is wound upon tubular bobbins 22 mounted thereon. When the desired quantity of yarn has been wound upon bobbins 22, as is illustratively the case with those shown mounted upon spindles 18, such full bobbins must be removed or "doffed" from the spindles and replaced by empty bobbins 22′, such as those shown in FIG. 1 adjacent the base of machine 10.

For the purpose of performing the foregoing and related functions, machine 10 is equipped with and serviced by an automatic doffing apparatus 24, only fragmentary portions of which are shown in the drawings. Except in certain specific aspects hereinafter noted, apparatus 24 may be and illustratively is of the same general construction as that disclosed in U.S. Pat. Nos. 3,786,621 and/or 3,827,227 and heretofore manufactured and sold by Platt Saco Lowell Corporation. Such apparatus includes a conveyor 26 extending generally longitudinally of machine 10 adjacent its base and having a plurality of bobbin-supporting peg-like elements spaced along its length. Apparatus 24 further includes means for at desired times simultaneously doffing full bobbins 22 from all of the spindles 18, then transporting such full bobbins downwardly to conveyor 26 and depositing the same upon alternate ones of the peg-like elements thereon, and thereafter transporting empty bobbins 22′ upwardly to spindles 18 and donning such empty bobbins upon the spindles. The aforesaid bobbin transporting means includes an elongate bobbin grasper member 30 which extends in generally parallel adjacent relationship to spindle rail 16 of machine 10 throughout substantially the entire length of such rail and which is movable at desired times relative to it between elevated and lowered positions such as are respectively indicated by the phantom-line and solid-line illustrations of member 30 in FIG. 1. Member 30 is supported for movement between the aforesaid elevated and lowered positions, and/or positions intermediate or adjacent thereto, by a plurality of identical linkage mechanisms 32 which underlie member 30 at spaced locations along its length. While only the endmost two linkage mechanisms 32*a*, 32*x* are shown in FIG. 1, additional ones (e.g., three to five more, depending upon the length of machine 10) underlie the unillustrated intermediate portion of bobbin grasper member 30. Each linkage mechanism 32 is of the Scott-Russell straight-line type and includes longer lever member 34 whose upper end portion is pivotally connected to bobbin grasper member 30, and a shorter lever member 36 whose upper end portion is pivotally connected to lever member 34. The lower end portions of members 34, 36 of each linkage mechanism 32 are disposed adjacent a draw bar or similar driver member 38 which extends along the base of machine 10 in generally parallel relationship to bobbin grasper member 30, and which is mounted for axial reciprocatory movement at desired times under the impetus of a piston-and-cylinder assembly 40 disposed adjacent one end of machine 10. The lower end portions of the shorter lever members 36 of linkage mechanisms 32 are pivotally connected to respective ones of a plurality of bracket members 42 which are mounted at longitudinally-fixed locations along the length of machine 10 adjacent draw bar 38 and which are pivotally movable in unison with each other, at desired times and by suitable drive means (not shown), about the longitudinal axis of draw bar 38 for the purpose of tilting linkage mechanisms 32 relative to the vertical and thus imparting lateral movement to the bobbin grasper member 30 connected to the upper end portions of mechanisms 32. The lower end portions of the longer lever members 34 of linkage mechanisms 32 are connected to draw bar 38, at spaced locations along its length and in a manner to be more fully described hereinafter, such that during normal operation of apparatus 24 they move linerally in unison with draw bar 38 and thus cause movement of bobbin grasper member 30 between elevated and lowered positions in response to reciprocatory movement of the draw bar.

Insofar as its above-discussed components are concerned, doffing apparatus 24 is generally similar to those disclosed in U.S. Pat. Nos. 3,786,621 and/or 3,827,227, to which reference may be made for a more detailed description if desired.

Figure 3:
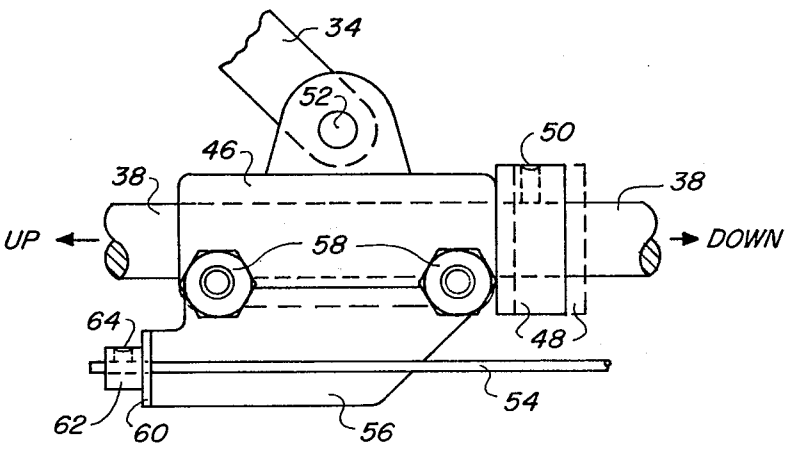
FIG. 3 is a front elevational view of the components shown in FIG. 2.
Figure 2:
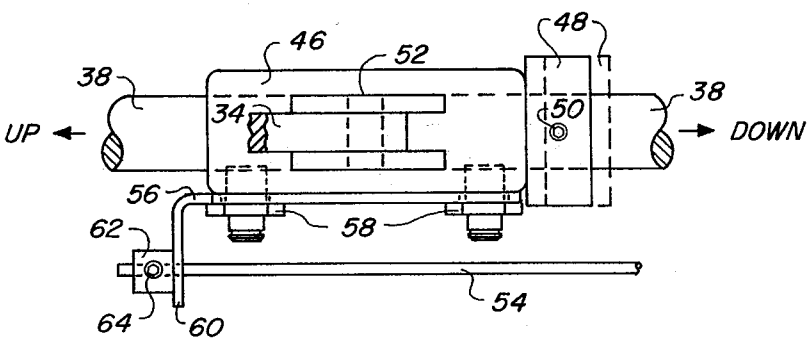
FIG. 2 is an enlarged fragmentary top plan view, taken in direction of the arrows 2—2 of FIG. 1, of components of the doffing apparatus and the stop-motion device associated with a lower end portion of that linkage mechanism of the apparatus which is adjacent one end of the textile machine.

Doffing apparatus 24 differs from those of the aforesaid patents in that, firstly, the lower end portion of the longer levers 34 of linkage mechanisms 32 are connected to draw bar 38 in such a manner that relative linear movement occurs between such draw bar and the lower end portion of one or more of the levers 34 upon impedence of the movement of bobbin grasper member 30 between elevated and lowered positions. Referring now also to FIGS. 2 and 3 of the drawings, the means innerconnecting draw bar 38 and the lower end portion of lever 34 of the illustrated linkage mechanism 32*a* includes a sleeve-like bracket member 46 and a collar member 48 mounted in adjacent relationship to each other upon draw bar 38. Collar 48 is fixedly secured to draw bar 38 in any suitable manner, as by means of a set-screw 50. Bracket member 46, to the upper portion of which lever 34 is pivotally secured as by means of a stud 52, is not fixedly secured to draw bar 38 but during normal operation of doffing apparatus 24 moves linerally in unison therewith as the draw bar is reciprocated for the purpose of moving bobbin grasper member 30 between elevated and lowered positions. At those times during operation of apparatus 24 when bobbin grasper member 30 is to be raised, draw bar 38 moves in the leftward direction indicated by the "up" arrows in FIGS. 2 and 3, and bracket 46 moves in unison therewith due to its abutment by the collar 48 secured to draw bar 38. When it is desired to lower bobbin grasper member 30 from an elevated position, draw bar 38 moves in the rightward direction indicated by the "down" arrows in FIGS. 2 and 3. If at such time the downward movement of bobbin grasper member 30 is unimpeded, bracket 46 will move to the right in substantial unison with draw bar 38 and remain in abutting relationship with collar 48, as shown in solid lines in FIGS. 2 and 3, due to the rightwardly-directed biasing forces imposed upon bracket 46 through lever 34 by the weight which the lever supports. But if during rightward movement of draw bar 38 the downward movement of bobbin grasper member 30 should be impeded in the vicinity of mechanism 32*a*, relative linear movement will occur between bracket 46, on the one hand, and draw bar 38 and collar 48, on the other hand. That is, in such circumstances bracket 46 will "lag behind" collar 48 as the latter moves in unison with draw bar 38 to the right, as is indicated by the phantom-line showing of collar 48 in FIGS. 2 and 3, and a gap or space will be created between the normally-abutting members 46, 48.

The other linkage mechanisms 32 spaced along the length of draw bar 38 are connected thereto in the same manner as described above with respect to linkage mechanism 32*a*. Like components of the other illustrated linkage mechanism 32*x* are identified in the drawings by the same reference numerals, with the addition of a prime designation, employed for the components associated with mechanism 32*a*.

A cable or similar elongate member 54 extends between and in closely adjacent relationship to the bracket members 46 associated with all of the linkage mechanisms 32 of apparatus 24. As is shown in FIGS. 2 and 3, the bracket member 46 associated with lifter mechanism 32*a* has a mounting plate 56 secured to its forward face by means of bolts. 58. Cable member 54 projects freely through a bore provided within a forwardly-extending flange 60 of mounting plate 56. A collar 62 encircles that terminal end portion of cable 54 to the left (as viewed in the drawings) of flange 60. Collar 62 abuts the adjacent face of flange 60 and is fixedly secured to cable 54 as by means of a set screw 64. At each of the additional unillustrated linkage mechanisms 32 spaced along the length of machine 10 between the end-most two mechanism 32*a*, 32*x*, cable 54 is connected to the sleeve-like bracket member 46 thereat by components identical to those discussed above and shown in FIGS. 2 and 3 with respect to linkage mechanism 32*a*.

Figure 4:
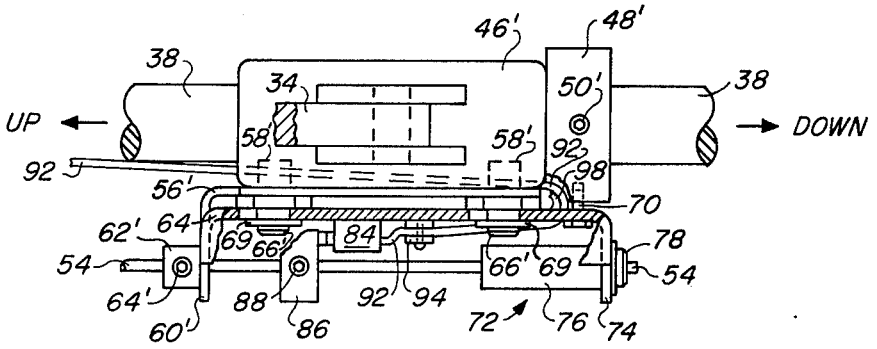
FIG. 4 is an enlarged fragmentary top plan view, taken in the direction of the arrows 4—4 of FIG. 1, of components of the doffing apparatus and of the stop-motion device associated with a lower end portion of that linkage mechanism of the apparatus adjacent the opposite end of the textile machine.
Figure 5:
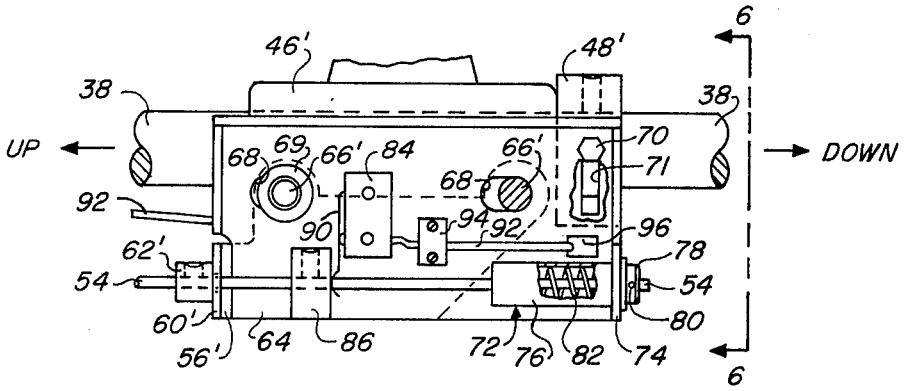
FIG. 5 is a front elevational view of the components shown in FIG. 4.
Figure 6:
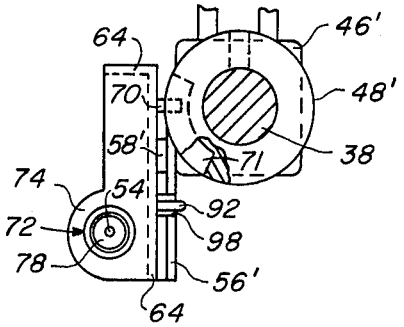
FIG. 6 is an end elevational view, taken in the direction of the arrow 6—6 of FIG. 5, of the components of FIGS. 4 and 5.

Cable-connecting components identical to those described and shown in association with linkage mechanism 32*a* are also provided in association with the linkage mechanism 32*x* at the opposite end of machine 10, such components being identified in FIGS. 4–6 by corresponding reference numerals with the addition of a prime designation. In the case of linkage mechanism 32*x*, however, additional components shown in FIGS. 4–6 and to be now described are also provided in association with the means interconnecting draw bar 38 and the lower end portion of lever 34 of such mechanism. Such additional components include a mounting plate 64 which extends in forwardly-spaced adjacent relationship to the mounting plate 56′ secured to bracket 46′ by bolts 58′. Stud-like elements 66′ formed integrally with bolts 58′ extend through slot-like openings 68 provided within plate 64, and are encircled adjacent their forwardmost or outer ends by washer-like retaining elements 69. Within the limits imposed by abutment of studs 66′ with the opposite extremities of slots 68, the aforesaid arrangement permits relative movement to transpire between plate 64 and the bracket 46 of FIGS. 4–6 in a direction approximately parallel to the axis of draw bar 38. A bolt 70 carried by plate 64 extends rearwardly therefrom into an arcuate groove 71 (FIGS. 5 and 6) provided within the adjacent cylindrical surface of the collar 48′ affixed to draw bar 38. Such innerconnection constrains plate 64 for linear movement at all times in unison with draw bar 38, but does not impede pivotal movement of bracket 46′ about the axis of draw bar 38.

Biasing means in the form of a spring-cartridge unit 72 projects through and is secured in any suitable manner to a forwardly-extending flange 74 of plate 64. The end portion of cable 54 extends axially through the housing and plunger components 76, 78 of unit 72, and the terminal portion of the cable is secured to plunger 78 as by means of a set screw 80. A coil spring 82 (FIG. 5) within housing 76 biases plunger 78 and therefore cable 54 to the right, as such components are viewed in FIGS. 4 and 5 of the drawings, and therefore resiliently maintains cable 54 in a taut condition.

As is best shown in FIG. 5, a switch element 84 is fixedly mounted in any suitable manner upon the forward face of plate 64. A collar-like actuating element 86, which encircles cable 54 and is secured thereto as by means of a set screw 88, abutingly engages the lower end portion of a resilient, downwardly-depending contact arm 90 of switch 84, and normally maintains arm 90 in its substantially vertically extending position shown in FIG. 5. Switch 84 is actuated by movement of the lower end of its arm 90 to the left, which transpires automatically due to the resilience of such arm when the same is allowed to undergo such movement. Electrical wiring servicing switch 84 is contained within a cord 92 which passes from switch 84 beneath a clamp 94 secured to the forward face of plate 64, thence through an opening 96 (FIG. 5) provided within such plate, thence around an arcuate guide element 98 (FIGS. 4 and 6) adjacent the rear face of plate 64 and the opening 96 therein, and thence to a take-up reel 100 (FIG. 1) mounted in any suitable manner adjacent the base of machine 10 and the bracket 42 associated with shorter lever 36 of lever mechanism 32*x*. Additional electrical leads (not shown) extending from reel 100 complete the electrical interconnection between switch 84 and the master control circuitry 102 (FIG. 1) within end cabinet 14 of machine 10 such that, upon actuation of switch 84, circuitry 102 halts operation of doffing apparatus 24 and/or produces other similar results of a customarily-desired nature, such as illumination of a signal light 104 (FIG. 1).

Due to the above-described innerconnection therewith, plate 64 and switch 84 move in unison with draw bar 38 when during operation of apparatus 24 the draw bar undergoes linear movement in the direction of its longitudinal axis for the purpose of moving bobbin grasper member 30 between elevated and lowered positions. Reel 100 automatically retracts cord 92 as switch 84 moves with draw bar 38 toward the bracket 42 associated with linkage mechanism 32*x* (to the left as viewed in the drawings), and automatically pays out cord 92 as switch 84 moves with draw bar 38 in the opposite direction (to the right as viewed in the drawing). During normal operation of apparatus 24 cable 54 also moves in unison with draw bar 38 since, as previously noted, the bracket 46′ associated with linkage mechanism 32*x* and the corresponding brackets 46 associated with each of the other linkage mechanisms 32 then do so. Switch arm 90 and the actuating element 86 upon cable 54 therefore continue to occupy the same positions relative to each other as are illustrated in FIGS. 4 and 5, in which positions switch 84 is not actuated, during normal operation of apparatus 24. However, if during axial movement of draw bar 38 to the right the normally-ensuring movement of bobbin grasper member 30 from an elevated and to a lowered position should be impeded at any point along its length, then as noted previously herein relative linear movement will occur between draw bar 38 and the bracket 46 of at least one of the linkage mechanisms 32, usually that mechanism 32 nearest the location along the length of bobbin grasper member 30 at which its movement is impeded, and switch 84 will be actuated. The manner in which the foregoing transpires can best be understood by assuming, firstly and for purposes of illustration, that the aforesaid impediment to movement of bobbin grasper member 30 is adjacent the linkage mechanism 32*x* and thus causes relative movement between the bracket 46′ and draw-bar collar 48′ shown in FIGS. 4–6. The effect of retardation of continued rightward movement of bracket 46′ in unison with draw bar 38 is transmitted to cable 54 through flange 60′ of the plate 56′ secured to bracket 46′, and thence through the collar-like member 62′ secured to cable 54. That portion of cable 54 to the right of collar 62′ is prevented from continuing its normal rightward movement in unison with draw bar 38. However, continuation of the rightward movement of plate 64 in unison with draw bar 38 is permitted to transpire for a limited distance, by the slots 68 within such plate and by then-ensuing compression by plunger 78 of the spring 82 of the spring-cartridge unit 72 encircling the terminal end portion of cable 54. Continued rightward movement of the switch element 84 secured to plate 64 so increases the distance between its resilient contact arm 90 and the actuating element 86 secured to cable 54, whose continued rightward movement has been arrested, as to cause actuation of switch 82. This in turn causes immediate cessation of the operation of doffing apparatus 24, and/or other similar desired results.

Switch 84 is similarly actuated if the impedence to movement of bobbin grasper member 30 occurs at any other, different location along its length. Thus, if movement of member 30 were impeded adjacent its extreme opposite end, to which linkage mechanism 32*a* (FIG. 1) is connected, relative linear movement would transpire between the bracket 46 and collar 48 shown in FIGS. 2 and 3 due to retardation of the normal movement of bracket 46 in unison with draw bar 38. The normal rightward movement of cable 54 in unison with draw bar 38 would therefore also be retarded, through the innerconnection provided between cable 54 and bracket 46 by plate 56 and collar 62 (FIGS. 2 and 3). The longitudinal distance between switch 84 (FIGS. 4 and 5) and the actuating element 86 secured to the opposite end portion of cable 54 would thus increase, causing actuation of switch 84, even though in this instance the bracket 46′ and collar 48′ of FIGS. 4–6 would remain in abutting relationship with each other.

If the impedence to movement of bobbin grasper member 30 should be located within the unillustrated intermediate part of its length, the result would be the same as described immediately above except that arresting of the movement of cable 54 would occur only in that portion thereof extending between end-most linkage mechanism 32*x* and the particular one of the intermediate linkage mechanisms 32 (not shown) most closely adjacent the obstruction impeding movement of bobbin grasper member 30.

Irrespective of the location along the length of bobbin grasper member 30 of the impediment to its movement, it will be noted that upon elimination of such impediment all components of doffing apparatus 24 will automatically restore themselves to their normal operating positions, without the necessity for manual "re-setting" of any components.

The utilization of switch actuating means, such as of that defined by cable 54 and its associated components, which extends substantially the entire length of bobbin grasper member 30 and is independently operable upon impedence of movement of bobbin grasper member 30 between its elevated and lowered positions at any location therealong, contributes significantly both to the economy and the desirable sensitivity of the present stop-motion device. In the latter connection, it will be appreciated by those skilled in the art that if the effect of impedence of the movement of bobbin grasper member 30 at, say, one end thereof, had to be transmitted through the full length of member 30 and/or through other elongate structural components of doffing apparatus 24 in order to actuate a stop-motion switch adjacent the other end portion of machine 10, bending or other structural damage of bobbin grasper member 30 would likely occur prior to halting of the operation of doffing apparatus 24. The present stop-motion device minimizes if not altogether obviates the possibility of such undesirable result occurring. Additionally, the use in the present stop-motion device of only a single switch element 84 enhances its economy and operational-reliability.

The illustrated and hereinbefore described innerconnection between cable 54 and the bracket 46 associated with each linkage mechanism 32, which innerconnection includes a flange 60 of a plate 56 which is bolted to the bracket 46, facilitates installation of the stop-motion device upon an existing doffing apparatus. It will be apparent, however, that in lieu of such innerconnecting arrangement, a flange or ear equivalent to flange 60 might be formed integrally with each bracket 46.

While a preferred embodiment of the invention has been specifically shown and described, this was for purposes of illustration only, and not for purposes of limitation, the scope of the invention being in accordance with the following claims.

That which is claimed is:

1. In an automatic bobbin doffing apparatus servicing a textile spinning frame or like machine having a plurality of upstanding bobbin receiving spindles mounted in a row extending longitudinally of the machine, said apparatus including an elongate bobbin grasper member extending in generally parallel adjacent relationship to said row of spindles, an elongate draw bar mounted in generally parallel underlying relationship to said bobbin grasper member for linear reciprocatory movement, and linkage means innerconnecting said bobbin grasper member and said draw bar for movement of said bobbin grasper member between elevated and lowered positions relative to said row of spindles in response to reciprocatory movement of said draw bar, the improvement comprising:

said linkage means including at least one linkage mechanism having a lower end portion connected to said draw bar for linear movement in unison therewith during normal operation of said apparatus and for relative linear movement between said draw bar and said lower end portion of said linkage mechanism upon impedence of said movement of said bobbin grasper member;

and stop-motion means actuable in response to said relative linear movement between said lower end portion of said linkage member and said draw bar for, upon actuation, halting operation of said apparatus.

2. Apparatus as in claim 1, wherein said linkage means includes at least a second linkage mechanism spaced from said first-mentioned linkage mechanism along the lengths of said bobbin grasper member and said draw bar; said second linkage mechanism having a lower end portion connected to said draw bar for linear reciprocatory movement in unison therewith during normal operation of said apparatus and for relative linear movement between said draw bar and said lower end portion of said second linkage mechanism upon impedence of the movement of said bobbin grasper member; and said stop motion means being actuable in response to said relative linear movement between said lower end portion of either of said linkage mechanisms and said draw bar.

3. Apparatus as in claim 2, wherein said stop-motion means includes a switch member mounted adjacent said draw bar for movement in unison therewith; and elongate switch-actuating means mounted in adjacent relationship to said draw bar and to said switch element and to said lower end portions of said linkage mechanisms for linear movement in unison therewith during normal operation of said apparatus, and for switch-actuating relative movement between said switch member and said switch-actuating means in response to said relative linear movement between said draw bar and said lower end portion of either of said linkage mechanisms.

4. Apparatus as in claim 3, wherein said switch-actuating means includes a cable member, and means including a plurality of collar-like elements carried by said cable member and innerconnecting said cable member and said lower end portions of said linkage mechanisms.

5. Apparatus as in claim 4, and further including a switch mounting plate connected to said draw bar for linear movement in unison therewith and mounting said switch element for said movement thereof; and resilient cable-biasing means carried by said switch mounting plate and innerconnecting said mounting plate and one end portion of said cable member for movement in unison with each other during normal operation of said apparatus and for relative movement between said end portion of said cable member and said plate at such times as said cable member is restrained at any location along its length from undergoing linear movement in unison with said draw bar.

6. Apparatus as in claim 5, wherein said switch-actuating means further includes a switch-actuating element affixed to said cable member adjacent said switch element.

7. Apparatus as in claim 5, wherein said stop-motion means further includes a cord member containing electrical leads connected to said switch element, clamp means connecting one end section of said cord member to said switch mounting plate for movement in unison therewith, and reel means mounted upon said textile machine for automatically paying out and reeling in said cord member as required in response to movement of said mounting plate in unison with movement of said draw bar.

8. In an automatic bobbin doffing apparatus servicing a textile spinning frame or like machine having a plurality of upstanding bobbin receiving spindles mounted in a row extending longitudinally of the machine, said apparatus including an elongate bobbin grasper member extending in generally parallel adjacent relationship to said row of spindles, an elongate draw bar mounted in generally parallel underlying relationship to said bobbin grasper member for linear reciprocatory movement, and linkage means innerconnecting said bobbin grasper member and said draw bar for movement of said bobbin grasper member between elevated and lowered positions relative to said row of spindles in response to reciprocatory movement of said draw bar, the improvement comprising:

said linkage means including at least three linkage mechanisms each having a lower end portion disposed adjacent said draw bar in longitudinally spaced relationship to the corresponding lower end portion of each of the other of said linkage mechanisms;

a plurality of innerconnecting means innerconnecting said lower end portions of corresponding ones of said linkage mechanisms to said draw bar for linear movement in unison therewith during normal operation of said apparatus and for relative linear movement between said draw bar and at least one of said lower end portions of said linkage mechanisms upon impedence of said movement of said bobbin grasper member;

and stop-motion means actuable in response to said relative linear movement between said draw bar and said lower end portion of any of said linkage mechanisms for, upon actuation, halting operation of said apparatus.

9. Apparatus as in claim 8, wherein each of said inner-connecting means includes a collar-like member fixedly secured to said draw bar, and a sleeve-like bracket member supporting said lower end portion of the associated one of said linkage mechanisms, said bracket member being carried by and slidable longitudinally of said draw bar and being normally biased into abutting relationship with said collar-like member.

10. Apparatus as in claim 9, wherein said stop-motion means includes a switch member mounted adjacent said draw bar for movement in unison therewith; and switch-actuating means, including a cable member operatively connected to the said bracket member associated with each of said linkage mechanisms, for actuating said switch member upon relative linear movement between said draw bar and said bracket member associated with any one of said linkage mechanisms.

11. In an automatic bobbin doffing apparatus servicing a textile spinning frame or like machine having a plurality of upstanding bobbin receiving spindles mounted in a row extending longitudinally of the machine, said apparatus including an elongate bobbin grasper member extending in generally parallel adjacent relationship to said row of spindles, an elongate draw bar mounted in generally parallel underlying relationship to said bobbin grasper member for linear reciprocatory movement, and linkage means innerconnecting said bobbin grasper member and said draw bar for movement of said bobbin grasper member between elevated and lowered positions relative to said row of spindles in response to reciprocatory movement of said draw bar, the improvement comprising:

said linkage means including a plurality of linkage mechanisms spaced relative to each other along the lengths of said bobbin grasper member and said draw bar, each of said linkage mechanisms including a lever member having an upper end portion connected to said bobbin grasper member and having a lower end portion adjacent said draw bar;

innerconnecting means innerconnecting said lower end portion of said lever member of each of said linkage mechanisms to said draw bar for linear movement in unison therewith during normal operation of said apparatus and for relative linear movement between said draw bar and said lower end portion of said lever member of at least one of said linkage mechanisms upon impedence of said movement of said bobbin grasper member; said innerconnecting means including, for each of said linkage mechanisms, a sleeve-like bracket member supporting said lower end portion of said lever member of the associated one of said linkage mechanisms, said bracket member being mounted upon and in encircling relationship to said draw bar for relative linear movement between said bracket member and said draw bar, and an abutment member fixedly secured to said draw bar adjacent said bracket member for during normal operation of said apparatus constraining relative linear movement between said bracket member and said draw bar;

a stop-motion switch member connected to said draw bar for linear movement in unison therewith;

and switch-actuating means for actuating said switch member in response to relative linear movement between said draw bar and said bracket member associated with any one of said linkage members; said switch-actuating means including a cable member connected to said bracket member associated with each of said linkage mechanisms, and a switch-actuating member carried by said cable member is adjacent relationship to said switch member.

* * * * *